US009068244B2

(12) United States Patent
Mitsui et al.

(10) Patent No.: US 9,068,244 B2
(45) Date of Patent: Jun. 30, 2015

(54) METHOD FOR RECOVERING CHROMITE, AND METHOD FOR WET SMELTING OF NICKEL OXIDE ORE

(75) Inventors: Hiroyuki Mitsui, Tokyo (JP); Osamu Nakai, Tokyo (JP); Hirotaka Kawasaki, Tokyo (JP); Hiroshi Kobayashi, Ehime (JP); Tatsuya Higaki, Ehime (JP); Atsushi Idegami, Ehime (JP)

(73) Assignee: SUMITOMO METAL MINING CO., LTD., Tokyo (JP)

( * ) Notice: Subject to any disclaimer, the term of this patent is extended or adjusted under 35 U.S.C. 154(b) by 0 days.

(21) Appl. No.: 14/384,616

(22) PCT Filed: Apr. 6, 2012

(86) PCT No.: PCT/JP2012/059504
§ 371 (c)(1),
(2), (4) Date: Sep. 11, 2014

(87) PCT Pub. No.: WO2013/150642
PCT Pub. Date: Oct. 10, 2013

(65) Prior Publication Data
US 2015/0014225 A1 Jan. 15, 2015

(51) Int. Cl.
*C22B 3/22* (2006.01)
*C22B 23/00* (2006.01)
(Continued)

(52) U.S. Cl.
CPC ..... *C22B 3/22* (2013.01); *C22B 23/005* (2013.01); *C22B 23/04* (2013.01); *B03B 7/00* (2013.01)

(58) Field of Classification Search
CPC ..... B03B 5/60; B03B 7/00; C22B 3/22; C22B 23/005; C22B 61/00
USPC ..... 209/3, 13, 17; 75/712, 749, 750; 423/1, 423/53, 61
See application file for complete search history.

(56) References Cited

U.S. PATENT DOCUMENTS 2,584,700 A * 2/1952 Hayward ..... 423/57
4,362,558 A 12/1982 Desnoes et al.
(Continued)

FOREIGN PATENT DOCUMENTS

JP A-52-23504 2/1977
JP A-2005-350766 12/2005
(Continued)

OTHER PUBLICATIONS

International Search Report issued in International Patent Application No. PCT/JP2012/059504 mailed Jul. 3, 2012, (2 pages).

*Primary Examiner* — Mark Beauchaine
(74) *Attorney, Agent, or Firm* — Oliff PLC

(57) ABSTRACT

A method for recovering chromite from ore slurry obtained by processing nickel oxide ore, the raw material, in a plant for the wet smelting of nickel oxide ore. In the method chromite is separated and recovered from an ore slurry obtained from a nickel oxide ore when nickel and cobalt are recovered from the nickel oxide ore. The method has a grain diameter separation step for separating the ore slurry on the basis of a predetermined classification point according to the difference in the grain diameter of particles contained in the supplied ore slurry and a sedimentation separation step for causing the oversized ore slurry separated in the grain diameter separation step to undergo sedimentation and concentration on the basis of a target classification point, and recovering the chromite. The coarse particle content of the oversized ore slurry separated in the grain diameter separation step is adjusted to 30-50%.

3 Claims, 6 Drawing Sheets

(51) Int. Cl.
*C22B 3/00* (2006.01)
*B03B 7/00* (2006.01)

(56) References Cited

U.S. PATENT DOCUMENTS 4,548,794 A * 10/1985 Lowenhaupt et al. ..... 423/123
2007/0034056 A1 2/2007 Miller et al.
2013/0149219 A1* 6/2013 Lakshmanan et al. ..... 423/22

FOREIGN PATENT DOCUMENTS

JP A-2007-528934 10/2007
JP A-2010-95788 4/2010
JP A-2012-107289 6/2012

* cited by examiner

METHOD FOR RECOVERING CHROMITE, AND METHOD FOR WET SMELTING OF NICKEL OXIDE ORE

FIELD OF THE INVENTION

The present invention relates to a chromite recovery method and a hydrometallurgical process for nickel oxide ore, more particularly to a chromite recovery method for efficiently recovering chromite from ore slurry produced by treating nickel oxide ore that is raw materials, and a hydrometallurgical process for nickel oxide ore to which the chromite recovery method is applied, in a hydrometallurgical plant for nickel oxide ore.

BACKGROUND OF THE INVENTION

Recently, the High Pressure Acid Leach (HPAL) using sulfuric acid has been gathering attention, as a hydrometallurgical process for nickel oxide ore. This process does not comprise dry steps, such as a drying step and a roasting step or the like, but comprises a continuous wet process. Thus, it is advantageous in regards to energy and cost. Additionally, this process has, at the same time, the advantage of capable of providing a mixed nickel-cobalt sulfide whose nickel grade is upgraded up to about 50% to 60% by weight or so.

As exemplified, for example in FIG. 5, the HPAL process for producing the mixed nickel-cobalt sulfide comprises a pretreatment step (1) of cracking and classifying nickel oxide ore into slurry (hereinafter referred to as "ore slurry"); a leaching step (2) of producing leached slurry, while stirring the ore slurry under temperature of 220 to 280 degrees C. by adding sulfuric acid to the produced ore slurry; a solid-liquid separation step (3) of solid-liquid separation the leached slurry to produce leachate containing nickel and cobalt (crude nickel sulfate aqueous solution) and a leached residue; a neutralization step (4) of neutralizing impurities by adding neutralizer (for example, calcium carbonate) to the produced crude nickel sulfate aqueous solution; a dezincification step (5) of removing zinc, as a zinc sulfide, by adding a hydrogen sulfide gas to a neutralized crude nickel sulfate aqueous solution; a sulfidization step (6) of producing a mixed nickel-cobalt sulfide and a nickel barren solution by adding the hydrogen sulfide gas to a produced dezinced final solution; and a detoxification step (7) of detoxifying the leached residue produced in the solid-liquid separation step (3), the zinc sulfide produced in the dezincification step (5), and the nickel barren solution and the like produced in the sulfidization step (6) (for example, see Patent Document 1).

In the hydrometallurgical process, because the more the amount of ore slurry to be treated in the steps increases, the larger the treatment facility becomes, it will become necessary to reduce the amount of ore slurry, that is, to adjust the ore slurry at a high concentration. On the other hand, it will become necessary to lower the viscosity of the ore slurry, that is, to prepare the ore slurry at a low concentration in order to facilitate a subsequent pipeline transfer.

Thus, in the above-mentioned hydrometallurgical process, there is a conflicting request to reduce the facility cost and facilitate a transfer of the ore slurry. To this end, it has been conventionally forced to proceed a treatment by adjusting an ore slurry concentration to 10% by weight or so.

In this connection, the hydrometallurgical process, such as the High Pressure Acid Leach (HPAL) process or the like are implemented by the plant facility comprised of a boiler generating steam for reaction temperature control of each step, a hydro sulfide production facility producing a hydro sulfide gas used mainly in the above-mentioned steps (5) and (6), further an irrigation facility, a power facility, and a plant facility composed of pipes, such as a flow feeding pipe sequentially coupling the each step, in addition to facilities responsible for the above-mentioned each step.

However, there remains unsettled a problem in this practical plant given in the following. That is, nickel oxide ore to be treated is transported as slurry among each step, but the slurry notably accelerates deterioration of the facility materials by wear. Among other things, a repair frequency is high especially in the facilities, such as a pipe and a pomp or the like used in the leaching step (2). This is the major cause of an increase in the maintenance cost and a decrease in an operation rate. Particularly, since chromite contained in the nickel oxide ore has a large particle diameter and is solid, the chromite is ingredients noticeably accelerating deterioration of the pipe and the pomp or the like by wear in the hydrometallurgical plant involving the transportation of the slurry. Thus, it is desirable to remove the chromite from crude ore to be treated in the leaching step (2).

As a countermeasure, there has been proposed in Patent Document 2 a technique of recovering chromite from ore slurry. Specifically, the technique disclosed in Patent Document 2 is a technique in which the chromite is physically separated depending on a particle diameter, with the ore slurry as a starting material, and recovers particles containing the chromite after a chromite particle and other particles are purified and separated. The technique, as shown in FIG. 6, takes advantage of a property that a particle diameter of the chromite in the ore slurry shows a relatively large grain distribution compared with that of the other particles, and thus their difference is noticeable, inter alia, in the vicinity of 50 to 100 μm.

However, this technique can only provide a recovery rate of 30% or so, as a recovery rate of target classification slurry containing the chromite, when the ore slurry is treated, as mentioned above, by adjusting an ore slurry concentration to 10% by weight or so. Namely, there still remains unsettled a problem that particles of 70% or so which have a particle size to be recovered and are contained in the ore slurry is remained without being recovered therefrom. Incidentally, the recovery rate of the target classification slurry indicates that which is calculated by an equation of "particle weight [g] more than target classification point in recovered slurry/particle weight [g] more than target classification point in supplied slurry".

In the conventional physical separation method, it has been taken measures of improving a recovery rate of the target classification slurry normally by reducing a slurry concentration to be supplied to 5% by weight, after diluting the ore slurry of 10% by weight, in order to improve a recovery rate of the target classification slurry. In this instance, it however entails shortcomings that it needs to provide a large facility attendant to the dilution of the ore slurry. Furthermore, in this case, it is necessary for the ore slurry once diluted to concentrate, and therefore the conventional technique is unfavorable as a real operation.

Since the chromite contained in the ore slurry can be served that is raw materials for metallic chromium and a chromium compound, it is expected to be reusing thereof. Nonetheless, as mentioned above, it has been considered to one of the main factors of causing serious wear in the ore slurry transporting facility (pipe and pomp, or the like) extending to the leaching step (2) as specific gravity and hardness of the chromite are greater than those of the other particles.

Accordingly, it has been longing hitherto for the advent of a method able to improve a recovery rate of the chromite, even if an ore slurry concentration is adjusted to 10% by weight or so. In particular, it has been wanted the emergence of a method able to efficiently recover the chromite from the ore slurry produced by treating the nickel oxide ore that is raw materials.

PRIOR ART DOCUMENT

Patent Document

PLT1: Japanese Patent Application Laid-Open No. 2005-350766

PLT2: Japanese Patent Application Laid-Open No. 2010-095788

SUMMARY OF THE INVENTION

The present invention has proposed in view of such circumstances immanent in the prior art. The object of the present invention is to provide a method of capable of efficiently recovering the chromite from the ore slurry produced by treating the nickel oxide slurry that is raw materials, in the hydrometallurgical plant for nickel oxide ore.

As a result of intensive study made by the inventors of the present invention to a promising method able to improve a recovery rate of the chromite from the ore slurry produced by slurrying the nickel oxide ore, in the hydrometallurgical process for nickel oxide ore, in order to attain the above-mentioned object. Consequently, the inventors found from this that the chromite can successfully be recovered, at a high recovery rate, without diluting the ore slurry, even if an ore slurry concentration to be supplied is 10% by weight or so, by applying a particle diameter separation treatment and a sedimentation separation treatment to the ore slurry and by adjusting a content percentage of coarse particles contained in the oversized slurry whose classification point is higher than a predetermined one produced in the particle diameter separation treatment. Thus, the inventors finally completed their invention.

Namely, a chromite recover method according to the present invention is a chromite recovery method for separating and recovering chromite from ore slurry produced from nickel oxide ore, when recovering nickel and cobalt from the nickel oxide ore, the method comprises: a particle diameter separation step of separating the ore slurry based on a predetermined classification point depending on a particle diameter difference of a particle contained in the ore slurry to be supplied which has a particle size of 2 mm or less; and a sedimentation separation step of sedimenting and concentrating oversized ore slurry separated in the particle diameter separation step based on a target classification point to recover the chromite; wherein a content ratio of a coarse particle in the oversized ore slurry separated in the particle diameter separation step is adjusted to 30 to 50%.

Namely, hydrometallurgical process for nickel oxide ore according to the present invention is a hydrometallurgical process for nickel oxide ore for transporting ore slurry derived by slurrying nickel oxide ore to a high pressure acid leaching facility where nickel and cobalt are leached to recover the nickel and the cobalt from leachate produced by solid-liquid separation leached slurry, the process comprises: a chromite recovery step including: a particle diameter separation step of separating the ore slurry which has a particle size of 2 mm or less based on a predetermined classification point depending on a particle diameter difference of a particle contained in the ore slurry; a sedimentation separation step of sedimenting and concentrating oversized ore slurry separated in the particle diameter separation step based on a target classification point to recover chromite; wherein a content ratio of a coarse particle in the oversized ore slurry separated in the particle diameter separation step is adjusted to 30 to 50%.

Advantageous Effect of the Invention

According to the present invention, the invention allows a recovery rate of the chromite from the supplied ore slurry to be improved, in the hydrometallurgical process for nickel oxide ore. This reduces loads, such as wear in the facility materials of the hydrometallurgical plant, thereby implementing efficient hydrometallurgy for nickel oxide ore.

DETAILED DESCRIPTION OF THE INVENTION

Figure 1:
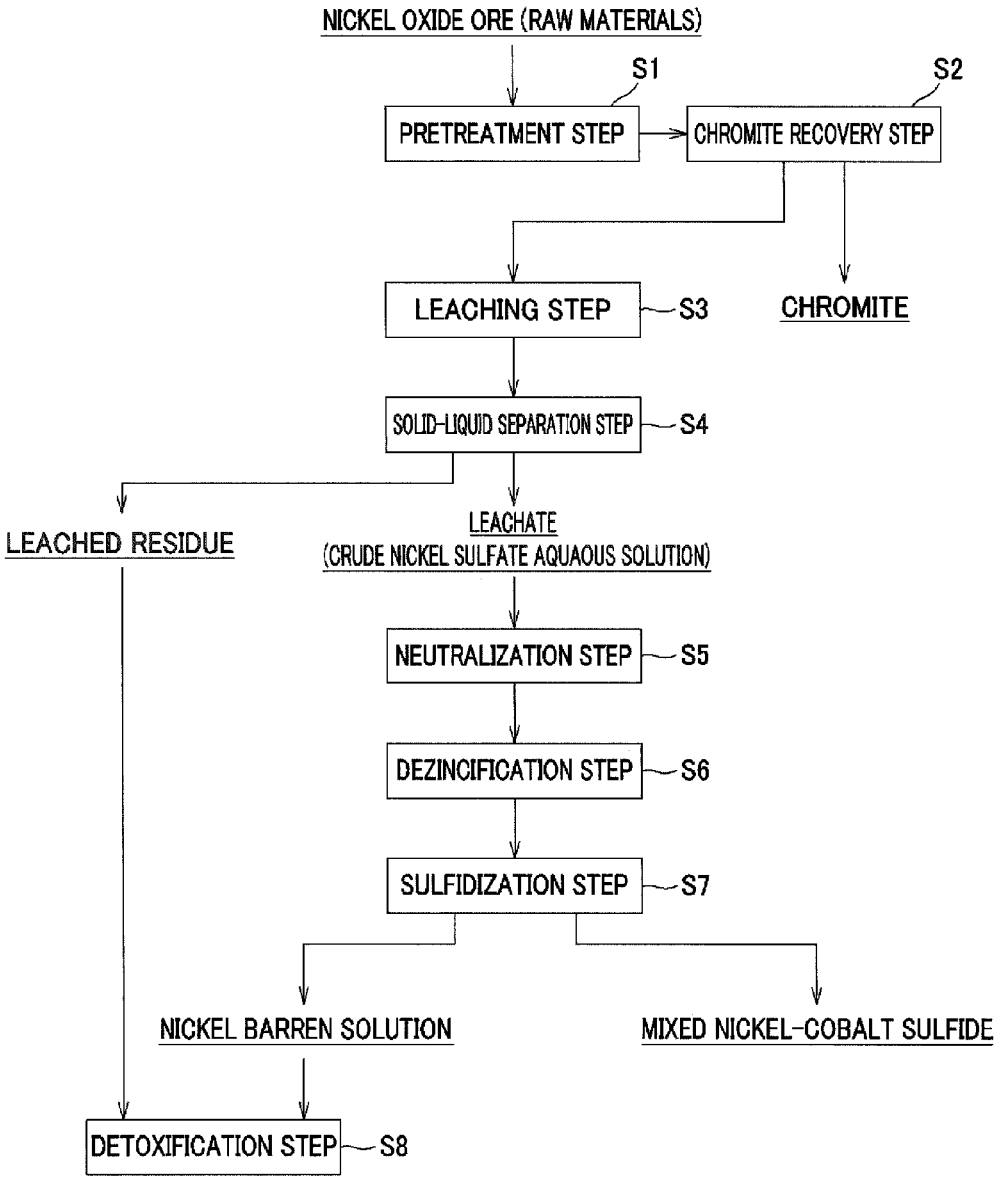
FIG. 1 is a flow chart showing one example of steps of hydrometallurgical process for nickel oxide ore according to the present embodiment.

Hereinafter, embodiments of a recovery method for chromite according to the present invention will be described in the order, with reference to the accompanying drawings.

1. Summary of the present invention
2. Hydrometallurgical process for nickel oxide ore
3. Examples

1. SUMMARY OF THE PRESENT INVENTION

A recovery method for chromite according to the present invention is for separating and recovering chromite from ore slurry which is produced by applying a cracking treatment or the like to nickel oxide for slurrying thereof, when recovering nickel and cobalt from the nickel oxide ore. The recovery method for chromite can apply to the hydrometallurgical process in which the nickel and the cobalt are recovered from the nickel oxide ore utilizing the HPAL process, for example. This realizes efficient hydrometallurgy enabling the chromite to be effectively recovered from the ore slurry of the nickel oxide ore for preventing deterioration of the hydrometallurgical plant by wear or the like due to the chromite, thereby realizing efficient hydrometallurgy.

Specifically, the recovery method for chromite according to the present invention comprises a particle diameter separation step of separating ore slurry based on a predetermined classification point depending on a particle diameter difference in particles contained in the ore slurry to be supplied; and a sedimentation separation step of sedimenting and concentrating oversized ore slurry separated in the particle diameter separation step based on a target classification point to recover the chromite. At this time, in the present invention, a content percentage of coarse particles in the oversized ore slurry separated in the particle diameter separation step is adjusted to 30 to 50%.

In the hydrometallurgical process for nickel oxide ore, since there is a conflicting demand to reduce the facility cost and facilitate transporting the ore slurry, it has been performed hydrometallurgy by adjusting an ore slurry concentration to 10% by weight or so. However, when an ore slurry concentration is adjusted to 10% by weight or so, only a recovery rate of 30% or so can be achieved as a recovery rate for target classification slurry containing chromite, resulting in a small recovery rate for chromite. Whereas reducing an ore slurry concentration to 5% by weight by diluting the ore slurry concentration to be supplied allows a recovery rate of the target classification slurry to be improved, the dilution of the slurry involves large facilities, and it must concentrate the diluted slurry. In these circumstances, it ends in failure in implementation of efficient hydrometallurgy.

Contrarily, according to the present invention, the invention enables chromite to be recovered at a high recovery rate without diluting the chromite, even if an ore slurry concentration to be supplied is 10% by weight or so, by applying a particle diameter separation treatment and a sedimentation separation treatment to the ore slurry, and by adjusting, to a predetermined ratio, a content percentage of coarse particles contained in oversized slurry whose classification point exceeds a predetermined one and which is produced in the particle diameter separation step.

A more specific description will be made in detail below by taking, as a specific example, a hydrometallurgical process for nickel oxide ore (hereinafter referred to as the "present embodiment") to which the recovery method for chromite according to the present invention is applied.

2. HYDROMETALLURGICAL PROCESS FOR NICKEL OXIDE ORE (HPAL)

FIG. 1 is a flow chart showing an outline of hydrometallurgical process for smelting nickel oxide ore utilizing the HPAL process. As shown in FIG. 1, the hydrometallurgical process utilizing the HPAL comprises a pretreatment step (nickel oxide ore treatment step) S1 of cracking and classifying the nickel oxide ore into slurry (ore slurry); a chromite recovery step S2 of recovering the chromite from the ore slurry produced in the pretreatment step S1; a leaching step S3 of producing leached slurry from the chromite recovery step S2 by adding sulfuric acid to the separated ore slurry; a solid-liquid separation step S4 of solid-liquid separation the leached slurry to produce leachate containing nickel and cobalt (crude nickel sulfate aqueous solution), and a leached residue; a neutralization step S5 of neutralizing impurities by adding neutralizer to the produced crude nickel sulfate aqueous solution; a dezincification step S6 of removing zinc by adding a hydrogen sulfide gas to the neutralized crude nickel sulfide aqueous solution; a sulfidization step S7 of producing a mixed nickel-cobalt sulfide and a nickel barren solution by adding the hydrogen sulfide gas to a produced dezinced final solution; and a detoxification step S8 of detoxifying the leached residue produced in the solid-liquid separation step S4, the zinc sulfide produced in the dezincification step S6, and the nickel barren solution produced in the sulfidization step S7.

(1) Pretreatment Step (Nickel Oxide Ore Treatment Step)

In the pretreatment step S1, the nickel oxide ore to be wet processed is crushed and classified to mix with water, and the ore slurry is produced by removing foreign matters and controlling a particle diameter of ore.

Specifically, in the pretreatment step S1, the nickel oxide is sieved with a wet sieve or the like to separate foreign matters unable to leach in the subsequent leaching step S3 and ore or the like having a particle diameter unable to flow feed with a pump. Herein, a sieving particle diameter is 2 mm or so, preferably is 1.4 mm. Ore having a particle diameter more than the above is cracked. Slurry is produced from the ore through the cracking and sieving treatment, and then the slurry is sedimented and concentrated to prepare ore slurry whose solid concentration (slurry concentration) in the slurry is adjusted. The ore slurry concentration is adjusted to 10% by weight or so.

As a nickel oxide ore, so-called lateritic ore, such as, limonite ore and saprolite ore or the like is mainly used. The nickel content of the lateritic ore is 0.8 to 2.5% by weight, and the nickel is contained as a hydroxide or hydrated calcium silicates (magnesium silicate) ore. The content of iron in the nickel is 10 to 50% by weight. The iron is contained in the nickel mainly in the form of a trivalent hydroxide (goethite), but bivalent iron is contained in part in the hydrate calcium silicates ore or the like. Further, silicic acid is contained in silica ore, such as quartz and cristobalite (amorphous silica) and the hydrate calcium silicate ore. Furthermore, the most of chromium is contained as chromite ore containing iron or magnesium. Moreover, magnesia is contained in calcium silicate ore scarcely containing nickel which is unweathered and has high hardness, in addition to the hydrate calcium silicates.

Thus, the lateritic ore that is raw materials contains, so-called, gangue ingredients scarcely containing nickel, such as chromite ore, silica ore, and hydrated calcium silicates ore or the like. The ore slurry produced through the pretreatment step S1 contains chromite and calcium silicates ore both of which have a great influence over wear in the facilities, such as a pipe and a pomp used in the subsequent leaching step S3, as well as magnesium consuming sulfuric acid in the leaching step. Additionally, the ore slurry contains calcium silicates ore whose nickel content is small. Among other things, especially, the chromite which has a relatively wide particle size distribution compared with other particles, and is hard has a serious impact on the facilities by loads, such as wear. For that reason, it is desirable to efficiently separate and recover the chromite from the ore slurry prepared in the pretreatment step S1. To this end, in the present embodiment, the chromite is separated and recovered from the ore slurry in the chromite recovery step S2, prior to the leaching step S3.

(2) Chromite Recovery Step

Figure 2:
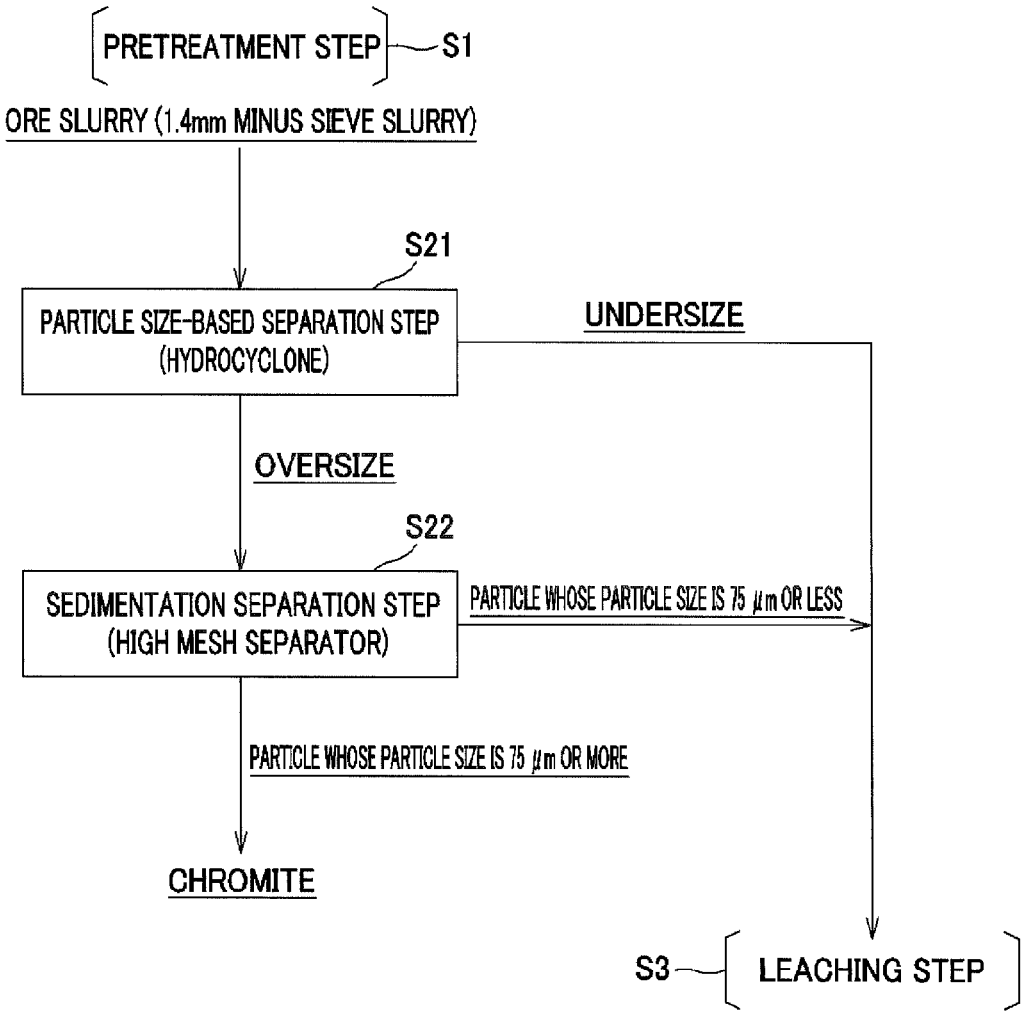
FIG. 2 is a flow chart showing one example of a chromite recovery step.

In the chromite recovery step S2, the chromite is physically separated and recovered from the ore slurry produced in the pretreatment step S1. FIG. 2 is a flow chart showing one example of steps of chromite recovery step S2. As shown in FIG. 2, the chromite recovery step S2 comprises a particle diameter separation step S21 of separating the ore slurry produced in the pretreatment step S1, based on a predetermined classification point depending on a particle diameter difference of particles contained in the ore slurry; and a sedimentation separation step S22 of sedimenting and concentrating oversized ore slurry separated in the particle diameter separation step S21 to recover the chromite.

Alternatively, while the chromite recovery step S2 is not necessarily performed through the above-mentioned particle diameter separation step S21 and the sedimentation separation step S22, the particle diameter separation step S21 may be configured to comprise 2 steps or more ($S21_1$, $S21_2$, . . . $S21_n$), and the ore slurry produced though the last particle diameter separation step $S21_n$ may be sedimented and concentrated in the sedimentation separation step S22.

(2-1) Particle Diameter Separation Step

In the particle diameter separation step S21, the ore slurry produced from the pretreatment step S2 is cast into a separator where the ore slurry is separated into undersized ore slurry (underflow) and oversized ore slurry (overflow), under a predetermined classification condition. The undersized ore slurry separated in the particle diameter separation step S21 is transported to the subsequent leaching step S3 shown in FIG. 1. Meanwhile, the oversized ore slurry is transported to the sedimentation separation step S22 to be described later.

As mentioned above, the particle diameter separation steps S21 may have multiple steps. In other words, the oversized ore slurry separated by the separator in the particle diameter separation step S21 may be cast into a second stage separator where the oversized ore slurry is separated into undersized ore slurry and oversized ore slurry, under a predetermined classification condition, and the treatment may appropriately be repeated over multiple stages.

The ore slurry produced through the pretreatment step S1 contains ore particles at an ore slurry concentration of 10% by weight or so, and its particle diameter is a few μm to 1.4 mm or so. As for its composition, out of the ore particles, goethite accounts for 70 to 80% by weight, serpentine accounts for 10% by weight or so, smectite accounts for 5% by weight or so. Besides, the ore slurry contains silicate and chromite or the like, and further, the nickel accounts for 0.5 to 2.0% by weight or so.

Herein, in the present embodiment, the oversized ore slurry is adjusted in the particle diameter separation step S21 so that it has a content percentage of coarse particles of 30 to 50%. Adjusting in this way the content percentage of the coarse particles to 30 to 50% allows slurry having a classification point higher than a predetermined one (target classification slurry) to be recovered, at a high recovery rate, even if an ore slurry concentration is 10% by weight or so, thereby improving a recovery rate of the chromite. In this connection, the content percentage of coarse particles indicates a ratio of a particle mass (g) having a particle diameter more than a predetermined target classification point (for example, 75 μm) with respect to a total drained weight (g).

As a classification treatment of the ore slurry in the particle diameter separation step S21, it is preferable to treat the ore slurry using a wet classification. Further, as a separator, it is preferable to use a hydrocyclone. For example, in a case where the hydrocyclone is used, classification conditions thereof includes inlet pressure (Mpa), an opening dimension of feedsim (mm), a voltex finder diameter (mm), and an apex valve diameter (mm) or the like. The classification condition is adjusted by adjusting these conditions. A specific description will be continued below, taking a case, as an example, where the particle diameter separation step S21 is performed by using the hydrocyclone.

As mentioned above, in the present embodiment, a content percentage of coarse particles in the oversized ore slurry classified in the particle diameter separation step S21 is adjusted to 30 to 50%. At this moment, when adjusting the content percentage of coarse particles, it should reduce a diameter of the apex valve of the hydrocyclone to intentionally lower a classification point. More specifically, for example, when the content percentage of coarse particles is adjusted to 30%, it should change the radius of the apex valve to 48 mm or so.

Thus, the oversized ore slurry whose radius of the apex valve of the hydrocyclone is reduced to intentionally lower the classification point, and a content percentage of coarse particles in the oversized ore slurry is adjusted to 30 to 50% is transported to the sedimentation separation step S22.

(2-2) Sedimentation Separation Step

In the sedimentation separation step S22, the oversized ore slurry whose content percentage of coarse particles is 30 to 50% and which is classified in the particle diameter separation step S21 is cast into the separator, such as a high mesh separator or the like where the oversized ore slurry is concentrated and separated into undersized ore slurry and oversized ore slurry based on a set target classification point. The undersized ore slurry separated in the sedimentation separation step S22 is transported to the subsequent leaching step S3 shown in FIG. 1, while the oversized ore slurry is recovered as ore slurry in which the chromite is concentrated.

The ore slurry in which the chromite is concentrated is subject to a dehydration drying treatment in another step to recover the chromite.

No special limitation is imposed on the target classification point to be set in the sedimentation separation step S22, but it is preferable to set the target classification point to 20 to 300 μm, considering also a property of material ore and a nickel yield or the like of a fine grain portion of the material ore, and more preferable to 50 to 100 μm from the point of view that the chromite may specifically be separated. In a case where the target classification point is set to less than 20 μm, it cannot concentrate and separate the chromite, and consequently improve a recovery rate of the chromite. Moreover, it is likely to loss nickel in the ore slurry. Meanwhile, in a case where the target classification point is set to more than 300 μm, it comes to insufficient separation of the chromite.

In the present embodiment, since a content percentage of coarse particles in the oversized ore slurry is adjusted to 30 to 50% in the precedent particle diameter separation step 21, and the ore slurry thereof is separated in the sedimentation separation step S22, the target classification slurry can be recovered, at a high recovery rate, even in an ore slurry concentration of 10% by weight or so. Further, in the present embodiment, the target classification slurry can be recovered, at a high recovery rate, even if the target classification point is set lower, as compared with the conventional one. Accordingly, the chromite can effectively be recovered from the slurry that is thus recovered at a high recovery rate, which effectively improves the recovery rate thereof. Particularly, setting a classification point to 50 to 100 μm enables the chromite to more specifically be concentrated and separated all the more, thereby substantially improving the recovery rate of the chromite.

Specifically, under the condition that an ore slurry concentration supplied from the pretreatment step S1 is 10% by weight, as mentioned above, a recovery rate of the target classification slurry can be augmented to about 80% by adjusting a content percentage of coarse particles in the oversized ore slurry to 30 to 50% in the particle diameter separation step S21. This provides a substantially improved recovery rate of the target ore slurry, as compared with the conventional one that is merely about 30%. The recovery rate of the target classification ore slurry of about 80% corresponds to about 40% when it is converted into a recovery rate of the chromite, thus substantially improving the recovery rate of the chromite as compared with the conventional one of about 15%.

As stated above, in the present embodiment, the embodiment comprises the particle diameter separation step S21 and the sedimentation separation step S22, as the chromite recovery step S2, subsequent to the pretreatment step S21. Adjusting a content percentage of coarse particles to 30 to 50% in the particle diameter separation step S21 allows the target ore slurry to be recovered, at a high recovery rate, even if the ore slurry has an ore slurry concentration of 10% by weight, thereby improving the recovery rate of the chromite.

Further, in the present embodiment, since the ore slurry produced through the chromite recovery step S2 whose recovery rate of the chromite is improved is transported to the leaching step S3, the embodiment can prevent a trouble such as wear from being caused in the transporting facility due to the chromite contained in the ore slurry, thereby realizing an efficient and effective hydrometallurgical treatment for nickel oxide ore.

Furthermore, the improved recovery rate of the chromite allows raw materials of metallic chromium and a chrominum compound to be efficiently recovered from the chromite, which realizes effective recycling thereof.

(3) Leaching Step

The undersized ore slurry separated in the particle diameter separation step S21 of the chromite recovery step S2, and the ore slurry whose classification point is below a predetermined one and which is separated in the sedimentation separation step S22 are transported to the leaching step S3 where leached slurry composed of leachate and a leached residue are produced by adding sulfuric acid to these ore slurry and leaching the ore slurry under high temperature over 200 degrees C. and high pressure.

No special limitation is imposed on a method for the HPAL process in the leaching step S3, but it is performed by the following method, for example. In other words, firstly, sulfuric acid is added to the transported ore slurry, and secondly, high pressure air as an oxidant and high pressure vapor as a heating source are blown therein, leached slurry is produced by stirring the ore slurry while controlling its temperature and pressure below specified pressure and temperature to produce leachate containing nickel and cobalt.

In the leaching step S3, leaching of the nickel and cobalt or the like as a sulfate, and immobilization of the leached ferrous sulfate as hematite are taken place by a leaching reaction and a high temperature hydrolysis reaction represented by the equations I to V below. Nevertheless, because the immobilization of a ferrous ion incompletely progresses, a liquid portion of the produced leached slurry generally contains bivalent and trivalent ferrous ions, in addition to the nickel and the cobalt or the like.

(Leaching Reaction)

$$MO+H_2SO_4 \Rightarrow MSO_4+H_2O \quad \text{equation (I)}$$

(where, in the equation (I) M denotes Ni, Co, Fe, Zn, Cu, Mg, Cr, Mn or the like)

$$2FeOOH+3H_2SO_4 \Rightarrow Fe_2(SO_4)_3+4H_2O \quad \text{equation (II)}$$

$$FeO+H_2SO_4 \Rightarrow FeSO_4+H_2O \quad \text{equation (III)}$$

<<High Temperature Hydrolysis Reaction>>

$$2FeSO_4+H_2SO_4+1/2O_2 \Rightarrow Fe_2(SO_4)_3+H_2O \quad \text{equation (IV)}$$

$$Fe_2(SO_4)_3+3H_2O \Rightarrow Fe_2O_3+3H_2SO_4 \quad \text{equation (V)}$$

Herein, an leaching operation is performed, under pressure created by predetermined temperature, for example, under 3 to 6 MPaG, and a high temperature pressurized vessel (autoclave) or the like able to cope with these conditions is used. This allows both of a leach rate of nickel and that of cobalt to be augmented to 90% or more and more preferably to 95% or more.

No limitation is imposed on operating temperature in the leaching step S3, but it is preferable to set 220 to 280 degrees C., and more preferably to 240 to 270 degrees C. Setting the temperature within the range of 220 to 280 degrees C. leads to immobilization of the most of iron as hematite. Meanwhile, in a case where the temperature is set to less than 220 degrees C., the iron is dissoluted and remained in a reaction solution as a reaction rate of the high temperature hydrolysis reaction is slow. Thus, a load in the subsequent neutralization step S5 for removing the iron increases, which makes separation of the iron from the nickel very difficult. Further, in a case where while temperature is raised above 280 degrees C., the high temperature hydrolysis reaction is accelerated, one encounters with difficulty in selection of materials of a vessel used for the high temperature pressure leaching. Accordingly, it is unfavorable as it is likely for the cost for steam to be high for temperature rising.

No limitation is imposed on the amount of sulfuric acid used in the leaching step S3, but it is preferable to select an excess quantity so that the iron contained in the ore is leached. For example, it is preferable to set to 200 to 500 kg per ore of 1 ton. This is because if the amount of addition of sulfuric acid exceeds 500 kg, it is unfavorable as the cost for sulfuric acid will increase.

It is preferable for pH of the produced leachate to adjust 0.1 to 1.0 from the point of view of filterability of the leached residue containing hematite to be produced through the solid-liquid separation step S4.

In this way, in the leaching step S3, the leached slurry whose most of the residue is hematite is produced. The leached slurry is then transported to the solid-liquid separation step S4.

(4) Solid-Liquid Separation Step

In the solid-liquid separation step S4, the leached slurry produced in the leaching step S3 is multistage cleaned to produce leachate containing zinc in addition to nickel and cobalt, and leached residue. This recovers the nickel or the like which is discarded in a state of being adhered to the leached residue.

In the solid-liquid separation step S4, a solid-liquid separation is performed by using a thickener after the leached slurry is mixed with a cleaning liquid. Specifically, firstly, the leached slurry is diluted by the cleaning liquid and secondly, the leached residue is concentrated as a sediment from the thickener for reducing the nickel adhered to the leached residue, according to the degree of dilution thereof. In a real operation, a thickener with such capability is coupled in a multistage way.

No special limitation is imposed on multistage cleaning used in the solid-liquid separation step S4, but it is preferable to use the Counter Current Decantation (CCD) in which a cleaning liquid not containing nickel is brought into contact with a countercurrent. This enables a cleaning liquid to be newly introduced into the system to be reduced, thereby attaining a recovery rate of 95% or more for nickel and cobalt.

No special limitation is imposed on the cleaning liquid used in the solid-liquid separation step S4, but it is preferable to use that which is free from nickel and does not affect at all the steps. Among other things, it is more preferable to use that whose pH is 1 to 3. Further, it is preferable to iteratively use the cleaning liquid.

No special limitation is imposed on a solid rate of the sedimented residue, but it is preferable 30 to 50% by weight. Put differently, in a case where the solid rate is less than 30% by weight, the sedimented residue contains a large quantity of moisture adhered thereon and loss of nickel becomes large. Meanwhile, in a case where the solid rate exceeds 50% by weight, it becomes difficult to stir and feed liquid.

(5) Neutralization Step

In the neutralization step S5, pH is controlled while suppressing oxidation of the leachate containing impurity elements together with nickel and cobalt to produce neutralized sediment slurry containing trivalent iron, and a sulfate solution, such as a crude nickel sulfate solution or the like that is a sulfidization initial solution from which the most of impurities are removed. This neutralizes the excess acid used in the leaching step S3 and removes a trivalent iron ion remained in the solution.

It is preferable for pH conditions in the neutralization step S5 to set to 4 or less, and more preferably 3.2 to 3.8. If once pH exceeds 4, generation of nickel hydroxide increases.

Further, in the neutralization step S5, it is preferable for an iron ion existing as bivalent in the solution not to be oxidized when removing a trivalent iron ion remained in the solution. Furthermore, it is preferable to prevent oxidation of the solution due to blowing and entrainment of air or the like.

It is preferable for temperature in the neutralization step S5 to set to 50 to 80 degrees C. In a case where the temperature conditions are set to less than 50 degrees C., a sediment becomes fine, which gives an adverse influence on the solid-liquid separation. Meanwhile, in a case where the temperature conditions are set to more than 80 degrees C., it invites lowered corrosion resistance of the plant materials and the increased energy cost for heating.

(6) Dezincification Step

In the dezincification step S6, prior to the sulfidization step S7 separating nickel and cobalt as sulfide, a hydrogen sulfide gas is blown in a sulfate solution containing zinc as impurity elements together with nickel and cobalt to produce a sulfide containing the zinc, and produce zinc sulfide sediment slurry and a mother liquid for nickel and cobalt recovery.

Specifically, in the dezincification step S6, a sulfate solution produced the neutralization step S5 containing zinc as impurity elements together with nickel and cobalt is introduced into a sulfidization reaction tank where the zinc contained in the sulfate solution is sulfurized (sulfidization reaction) by adding a hydrogen sulfide gas to the sulfidization reaction tank. After that, a zinc sulfide and a post-dezincification solution produced by the solid-liquid separation are produced.

The dezincification step S6 is for preventing zinc from being intruded into a mixed nickel-cobalt sulfide to be recovered in a subsequent sulfidization step S7. Accordingly, it is preferable for a condition of the sulfidization reaction in the dezincification step S6 to set to a condition under which the zinc is more preferentially sulfurized by a sulfidization reaction than nickel and cobalt. Specifically, a sulfidization reaction rate is inhibited by creating a weak reaction condition during the sulfidization reaction to selectively remove the zinc by inhibiting coprecipitation of nickel having a concentration higher than that of zinc.

When the amount of zinc contained in the crude nickel sulfate aqueous solution is very little to the extent that mixing of the zinc in the mixed nickel-cobalt sulfide to be produced in a post process is negligible, the dezincification step S6 may be omitted.

(7) Sulfidization Step

In the sulfidization step S7, the nickel and the cobalt in the mother liquid for nickel and cobalt recovery (post-dezincification solution) is sulfurized by adding a hydrogen sulfide gas to the mother liquid produced in dezincification step S6 to produce a mixed nickel-cobalt sulfide and a nickel barren solution (smelted waste fluid).

In the sulfidization step S7, a seed crystal composed of the sulfide containing produced nickel and cobalt may be cast into the sulfidization reaction tank, if necessary.

(8) Detoxification Step

In the detoxification step S8, the leached residue produced in the solid-liquid separation step S4, the zinc sulfide produced in the dezincification step S6, and the nickel barren solution produced in the sulfidization step S7 are detoxified.

Since the nickel barren solution to be transported to the detoxification step S8 slightly contains nickel and cobalt that are a recovery loss, they can be recycled as recovery raw materials of nickel and cobalt, and as a cleaning liquid for the leached residue and the neutralized residue produced in the neutralization step, after being detoxified in the detoxification step S8.

3. EXAMPLES

Hereafter, a description will be made to specific examples of the present invention. It should be noted that the present invention is not necessarily limited to one of the Examples below.

Examples

In the present Examples, the or slurry produced by cracking the nickel oxide ore is used to recover chromite from the ore slurry by a chromite recovery method to be described later, in the hydrometallurgical process for nickel oxide ore. Herein, an analysis for metals used in the following Examples is conducted by using the fluorescent X-ray analysis or the ICP emission analysis.

Example 1

In Example 1, ore slurry produced by cracking nickel oxide ore to a size of 1.4 mm or less is prepared so that an ore slurry concentration is 10% by weight. Firstly, a particle diameter separation treatment is performed based on a particle diameter difference, with a hydrocyclone (MD-9 type, made by Daiki Ataka Engineering Co., Ltd.) whose rated classification point is 50 μm to separate the ore slurry into undersized ore slurry (underflow) and oversized ore slurry (overflow). At this moment, a content percentage of coarse particles in the overflow is 30% under classification conditions of the hydrocyclone shown in Table 1.

The overflow whose content percentage of coarse particles produced by a particle diameter separation treatment is 30% is subject to a sedimentation separation treatment in which the ore slurry is sedimented and concentrated with a high mesh separator (KUC-612S type, made by KIKOSHA CO., LTD.) to recover the chromite contained in the slurry. A target classification point of the high mesh separator is set to 75 μm as shown in Table 1.

Example 2

In Example 2, the chromite is recovered, as with Example 1, excepting that a content percentage of coarse particles in the overflow produced by a particle diameter separation treatment is set to 48% under the classification conditions of the hydrocyclone as shown in Table 1.

TABLE 1

| | classification conditions of hydrocyclone | | | | | target |
|---|---|---|---|---|---|---|
| | Inlet pressure (Mpa) | opening dimension of feedsim (mm) | diameter of voltex finder (mm) | diameter of apex valve (mm) | content percentage of coarse particles (%) | classification point of high mesh separator (μm) |
| Example 1 | 0.22 | 50 × 80 | 76 | 48 | 30 | 75 |
| Example 2 | 0.24 | 10 × 80 | 58 | 48 | 48 | 75 |

(Measurement Results of Example 1)

A recovery rate of target classification (+75 μm) slurry produced through the particle diameter separation treatment and the sedimentation separation treatment in Example 1 and measurement results of a recovery rate of chrome are tabulated in Table 2 below. Further, a transition of the recovery rate (%) of the target classification slurry with respect to a retention time of the high mesh separator is depicted in a graph of FIG. 3 (denoted by blackening "□" in the graph). Hereupon, the results (denoted by whitening "◇" in the graph) of Comparative Example 3 (content percentage of coarse particles is 10%) to be described later are depicted together in the graph of FIG. 3.

TABLE 2

<Example 1>

| | Cr (%) | Ni (%) | Mg (%) | Si (%) | Fe (%) | +75 μm recovery rate of slurry (%) | recover rate of chrome (%) |
|---|---|---|---|---|---|---|---|
| Raw material slurry | 3.2 | 1.4 | 0.9 | 2.0 | 56.2 | — | — |
| High mesh separator +75 μm slurry | 13.1 | 0.5 | 2.4 | 1.7 | 39.8 | 78.0 | 40 |

As shown in Table 2, a recovery rate of the target classification slurry can be augmented to 78.0% and a recovery rate of the chromite also to 40% by controlling classification conditions in the particle diameter-based classification step, especially, a diameter of the apex valve to set a content percentage of coarse particles in the overflow to 30%.

Figure 3:
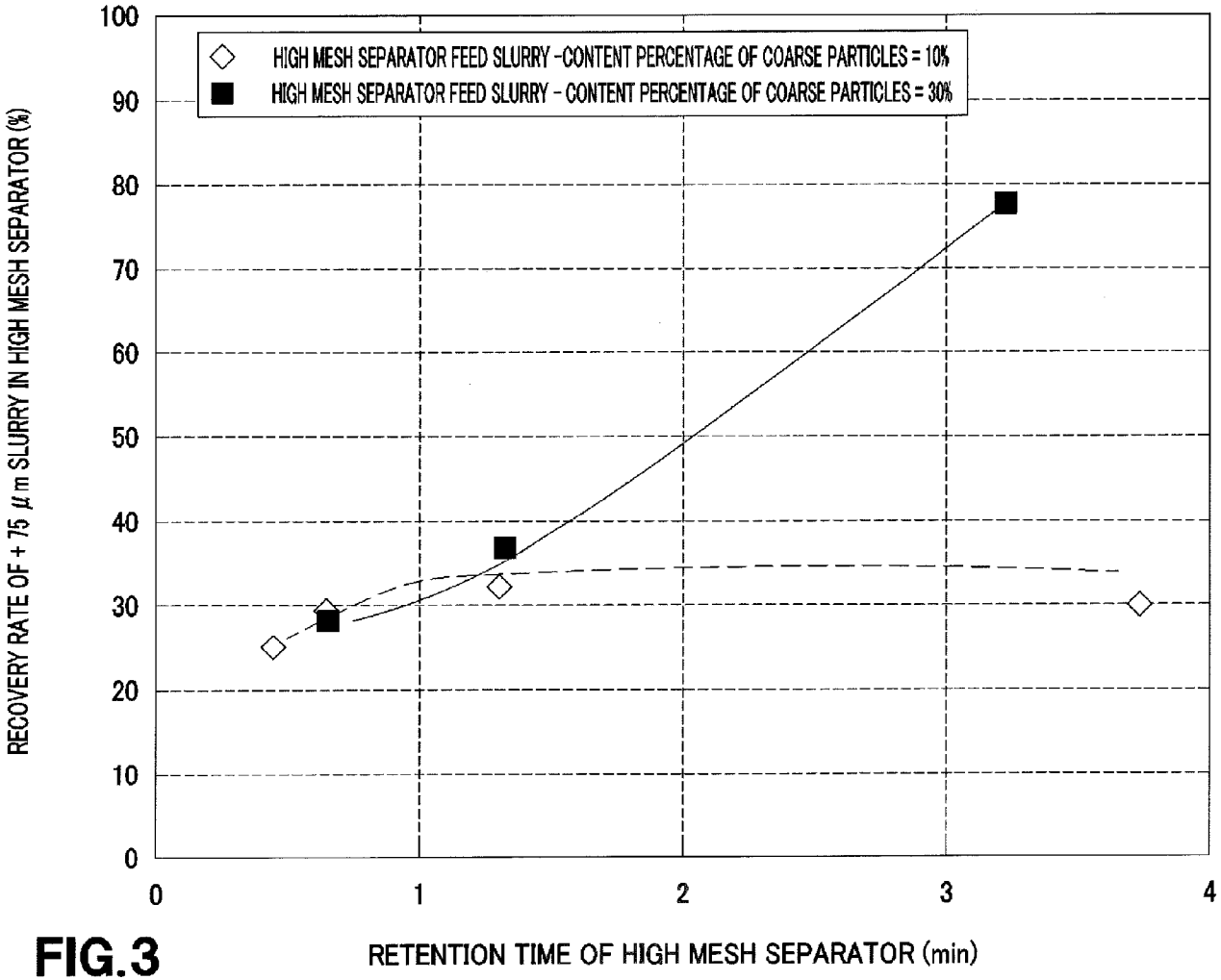
FIG. 3 is a graph illustrating a relationship between a retention time of a high mesh separator and a recovery rate of target classification slurry.

In Example 1, FIG. 3 showed a recovery rate of the target classification slurry is substantially improved, even compared with Comparative Example in which a content percentage of the overflowed coarse particles in the overflow is set to 10%, after the separation treatment, as with the prior art.

(Measurement Results of Example 2)

The measurement results of a recovery rate of the target classification (+75 μm) slurry and a recovery rate of the chrome obtained through the particle diameter separation treatment and the sedimentation separation treatment in the Example 2 are tabulated in Table 3 below.

TABLE 3

<Example 2>

| | Cr (%) | Ni (%) | Mg (%) | Si (%) | Fe (%) | +75 μm recovery rate of slurry (%) | recover rate of chrome (%) |
|---|---|---|---|---|---|---|---|
| Raw material slurry | 2.0 | 1.2 | 1.5 | 5.3 | 45.0 | — | — |
| High mesh separator +75 μm slurry | 6.2 | 1.1 | 4.3 | 11.5 | 34.1 | 77.4 | 29 |

As shown in Table 3, even in Example 2, a recovery rate of the target classification slurry can be augmented to 77.4% and a recovery rate of the chromite also to 29% by controlling classification conditions in the particle diameter classification step, especially, a diameter of the apex valve to set the content percentage of coarse particles in the overflow to 48%.

Comparative Examples 1 to 3

As Comparative Examples, a particle diameter separation treatment with the hydrocyclone and the sedimentation separation treatment with the high mesh separator are performed, as with Example 1, by adjusting the ore slurry produced by cracking the nickel oxide ore into 1.4 mm or less so that an ore slurry concentration is 3% by weight (Comparative Example 1), 5% by weight (Comparative Example 2), and 10% by weight (Comparative Example 3), respectively.

At this time, in the Comparative Examples 1 to 3, the particle diameter separation treatment and the sedimentation separation treatment are performed, with classification conditions by the hydrocyclone in the particle diameter separation treatment being adjusted to the same conditions as conventional ones shown in Table 4 below, and the content percentage of coarse particles in the overflow being adjusted to 10%.

TABLE 4

| | classification conditions of hydrocyclone | | | | content |
|---|---|---|---|---|---|
| | Inlet pressure (Mpa) | opening dimension of feedsim (mm) | diameter of voltex finder (mm) | diameter of apex valve (mm) | percentage of coarse particle s (%) |
| Comparative Examples 1 to 3 | 0.22 | 50 × 80 | 76 | 66 | 10 |

(Measurement Results of Comparative Examples 1 to 3)

Figure 4:
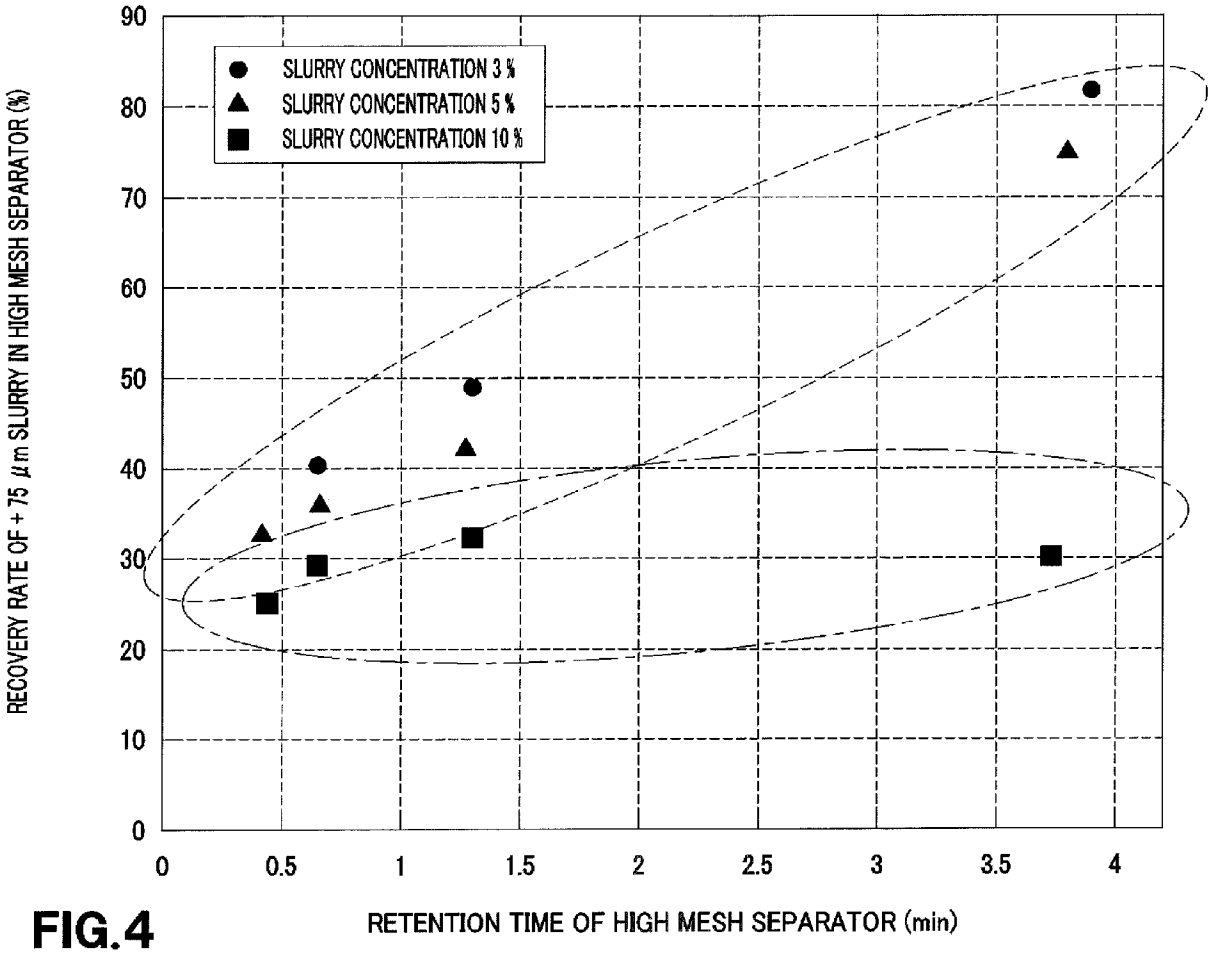
FIG. 4 is a graph illustrating a relationship between a retention time of a high mesh separator and a recovery rate of target classification slurry.
Figure 5:
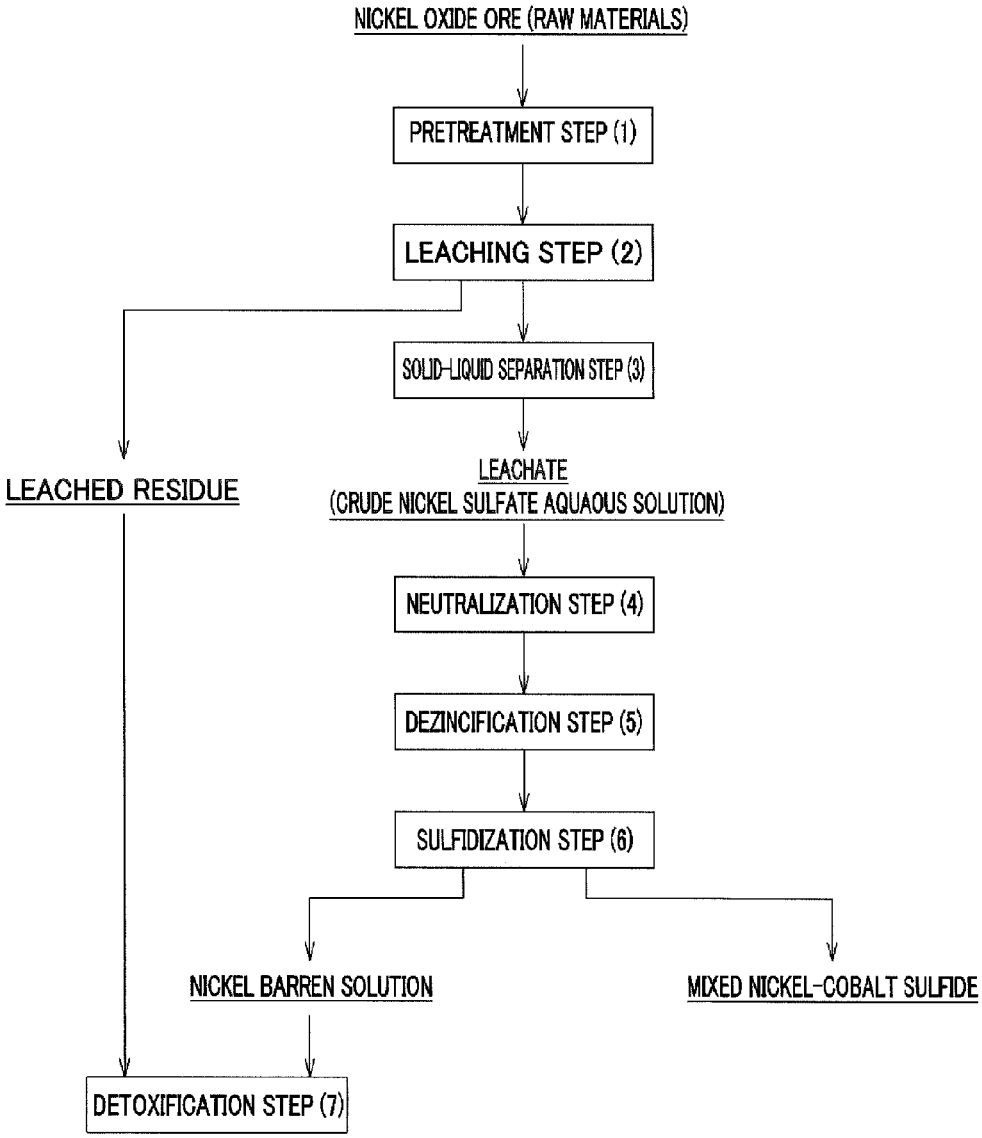
FIG. 5 is a flow chart showing one example of steps of hydrometallurgical process for nickel oxide ore.
Figure 6:
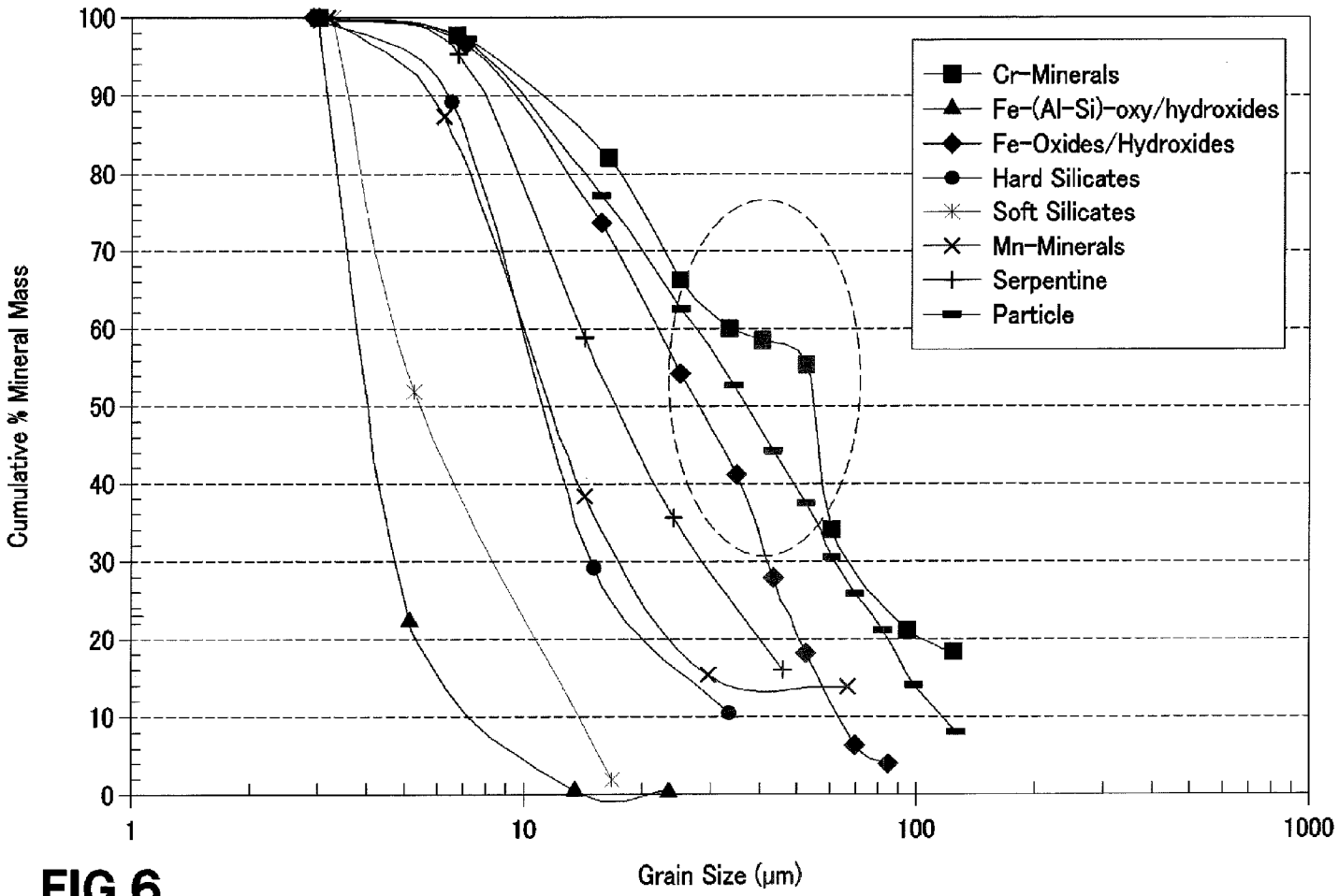
FIG. 6 is a graph illustrating a relationship between a particle size distribution and a content percentage of each element contained in the nickel oxide ore.

FIG. 4 shows a transition of a recovery rate (%) of the target classification (+75 μm) slurry with respect to a retention time (min) of the high mesh separator, as the results of Comparative Examples 1 to 3.

As shown in FIG. 4, in a case where an ore slurry concentration to be supplied is 3% by weight and 5% by weight, a retention time is long, that is, under the conditions where a flow rate of the supplied slurry is small, a recovery rate of the slurry is about 70 to 80% or so. Contrarily, in a case where an ore slurry concentration to be supplied is 10% by weight, a recovery rate of the target classification slurry amounts only to 30% or so, in either case of the flow rates of the slurry, it could barely recover 15% by weight or so, in terms of a recovery rate of the chromite.

INDUSTRIAL APPLICABILITY

As mentioned above, the recovery method for chromite according to the present invention enables a recovery rate of the chromite from the ore slurry whose ore slurry concentration is 10% by weight or so, and which is produced by slurrying the nickel oxide ore to be substantially improved. Applying the recovery method to the hydrometallurgical process for nickel oxide ore effectively prevents wear from being occurred in the transporting facilities, such as the pipe and the pomp, when transporting the ore slurry to each hydrometallurgical process, such as the leaching step or the like, thereby making it possible to realize efficient hydrometallurgy for nickel oxide ore. It is evident from this that their industrial value is very high.

The invention claimed is:

1. A chromite recovery method for separating and recovering chromite from ore slurry produced from nickel oxide ore when recovering nickel and cobalt from the nickel oxide ore, the method comprises:

a particle diameter separation step of separating the ore slurry which has a particle size of 2 mm or less based on a predetermined classification point depending on a particle diameter difference of particles contained in the ore slurry to be supplied; and a sedimentation separation step of sedimenting and concentrating oversized ore slurry separated in the particle diameter separation step to recover the chromite, wherein a content percentage of coarse particles in the oversized ore slurry separated in the particle diameter separation step is adjusted to 30 to 50%.

2. The recovery method for chromite according to claim 1, wherein a concentration of ore slurry supplied to the particle diameter separation step is 10% by weight.

3. A hydrometallurgical process for nickel oxide slurry for transporting ore slurry produced by slurrying nickel oxide ore to a high pressure acid leach facility where nickel and cobalt are leached to recover the nickel and cobalt from leachate produced by solid-liquid separation leached slurry, the process comprises:

a chromite recovery step including:

a particle diameter separation step of separating the ore slurry which has a particle size of 2 mm or less based on a classification point depending on a particle diameter difference of particles contained in the ore slurry; and a sedimentation separation step of sedimenting and concentrating oversized ore slurry separated in the particle diameter separation step based on a target classification point to recover chromite, wherein a content percentage of coarse particles in the oversized ore slurry separated in the particle diameter separation step is adjusted to 30 to 50%.

* * * * *